US010655555B2

(12) United States Patent
Nagakura

(10) Patent No.: US 10,655,555 B2
(45) Date of Patent: May 19, 2020

(54) ENGINE SYSTEM AND METHOD OF CONTROLLING ENGINE SYSTEM

(71) Applicant: TOYOTA JIDOSHA KABUSHIKI KAISHA, Toyota-shi, Aichi-ken (JP)

(72) Inventor: Keisuke Nagakura, Anjo (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 4 days.

(21) Appl. No.: 15/869,222

(22) Filed: Jan. 12, 2018

(65) Prior Publication Data

US 2018/0202384 A1 Jul. 19, 2018

(30) Foreign Application Priority Data

Jan. 16, 2017 (JP) ..... 2017-005093

(51) Int. Cl.
*F02D 41/30* (2006.01)
*F02D 41/22* (2006.01)
*F02D 41/26* (2006.01)

(52) U.S. Cl.
CPC ..... *F02D 41/3094* (2013.01); *F02D 41/221* (2013.01); *F02D 41/26* (2013.01); *F02D 2041/224* (2013.01)

(58) Field of Classification Search
CPC ..... F02D 17/04; F02D 41/22; F02D 41/221; F02D 41/30; F02D 41/3082; F02D 41/3094; F02D 41/3854; F02D 41/062; F02D 41/32; F02D 41/38; G06F 19/00
USPC ..... 701/102–105, 107, 114; 123/431, 479, 123/486
See application file for complete search history.

(56) References Cited

U.S. PATENT DOCUMENTS 5,461,569 A * 10/1995 Hara ..... F02D 41/1495 123/198 D
5,535,621 A * 7/1996 Glidewell ..... F02D 41/221 123/478
5,727,528 A 3/1998 Hori et al.
(Continued)

FOREIGN PATENT DOCUMENTS

JP 09-250376 A 9/1997
JP 2010-196506 A 9/2010
(Continued)

*Primary Examiner* — John Kwon
*Assistant Examiner* — Johnny H Hoang
(74) *Attorney, Agent, or Firm* — Finnegan, Henderson, Farabow, Garrett & Dunner, LLP

(57) ABSTRACT

An engine system includes: an engine including a direct injection valve that injects fuel into a cylinder of the engine and a port injection valve that injects fuel into an intake port of the engine; and an electronic control unit configured to control an operation of the engine by adjusting, based on a state of the engine, a rate of fuel injection from the direct injection valve with respect to total fuel injection and a rate of fuel injection from the port injection valve with respect to the total fuel injection. The electronic control unit executes a malfunction diagnosis with the rate of fuel injection from the direct injection valve set to 100%, when the electronic control unit determines that an execution condition for executing the malfunction diagnosis on a fuel system is satisfied and a power required of the engine is equal to or greater than a prescribed power.

2 Claims, 2 Drawing Sheets

(56) References Cited

U.S. PATENT DOCUMENTS

| | | | | |
|---|---|---|---|---|
| 7,596,447 | B2 * | 9/2009 | Oono | F02D 41/221 123/457 |
| 7,788,019 | B2 * | 8/2010 | Yamashita | F02D 41/0002 123/479 |
| 8,118,006 | B2 * | 2/2012 | Pursifull | F02D 41/0027 123/299 |
| 8,261,721 | B2 * | 9/2012 | Mizuno | F02D 41/221 123/431 |
| 8,442,745 | B2 * | 5/2013 | Ando | F02D 41/3863 123/479 |
| 9,593,637 | B2 * | 3/2017 | Surnilla | F02D 41/3076 |
| 10,125,713 | B2 * | 11/2018 | Esposito | F02D 41/221 |
| 2011/0017176 | A1 | 1/2011 | Mizuno et al. | |
| 2012/0103312 | A1 * | 5/2012 | Sasai | F02D 17/02 123/575 |
| 2015/0144116 | A1 | 5/2015 | Anzawa | |

FOREIGN PATENT DOCUMENTS

| | | |
|---|---|---|
| JP | 2011-26961 | 2/2011 |
| JP | 2015-101983 A | 6/2015 |

* cited by examiner

ENGINE SYSTEM AND METHOD OF CONTROLLING ENGINE SYSTEM

INCORPORATION BY REFERENCE

The disclosure of Japanese Patent Application No. 2017-005093 filed on Jan. 16, 2017 including the specification, drawings and abstract is incorporated herein by reference in its entirety.

BACKGROUND

1. Technical Field

The disclosure relates to an engine system, and relates also to a method of controlling an engine system.

2. Description of Related Art

Japanese Unexamined Patent Application Publication No. 2011-26961 (JP 2011-26961 A) describes an engine system including an engine provided with a direct injection valve configured to inject fuel directly into a cylinder of the engine. In the engine system, when a malfunction has occurred in a fuel system, it is determined whether the malfunction has occurred in the direct injection valve or in a port injection valve configured to inject fuel into an intake port of the engine. According to JP 2011-26961 A, there are provided three counters, that is, a fuel system malfunction counter for a case where the rate of fuel injection from the direct injection valve is 100%, a fuel system malfunction counter for a case where the rate of fuel injection rate from the direct injection valve is 0%, and a fuel system malfunction counter for a case where the rate of fuel injection from the direct injection valve is higher than 0% and is lower than 100%. According to JP 2011-26961 A, it is determined whether a malfunction has occurred in the direct injection valve or in the port injection valve based on these three counters.

SUMMARY

In the engine system described above, when the engine is operated at low load, for example, at idle, with the rate of fuel injection from the direct injection valve set to 100% in order to execute a malfunction diagnosis, the feedback control of the air-fuel ratio is not executed appropriately in some cases because the amount of fuel injected from the direct injection valve is small. As a result, the air-fuel ratio may be richer (lower) than or leaner (higher) than a target value. In this case, the emission may deteriorate.

The disclosure provides an engine system and a method of controlling an engine system, the engine system and the method suppressing deterioration of emission during a malfunction diagnosis.

A first aspect of the disclosure relates to an engine system including an engine and an electronic control unit. The engine includes a direct injection valve and a port injection valve. The direct injection valve is configured to inject fuel into a cylinder of the engine. The port injection valve is configured to inject fuel into an intake port of the engine. The electronic control unit is configured to control an operation of the engine by adjusting, based on a state of the engine, a rate of fuel injection from the direct injection valve with respect to total fuel injection and a rate of fuel injection from the port injection valve with respect to the total fuel injection. The electronic control unit is configured to execute a malfunction diagnosis with the rate of fuel injection from the direct injection valve set to 100%, when the electronic control unit determines that an execution condition for executing the malfunction diagnosis on a fuel system is satisfied and a power required to be output from the engine is equal to or greater than a prescribed power.

With this configuration, the operation of the engine is controlled by adjusting, based on the state of the engine, the rate of fuel injection from the direct injection valve with respect to total fuel injection and the rate of fuel injection from the port injection valve with respect to the total fuel injection. When the execution condition for executing the malfunction diagnosis on the fuel system is satisfied and the power required to be output from the engine is equal to or greater than the prescribed power, the malfunction diagnosis is executed with the rate of fuel injection from the direct injection valve set to 100%. When the power required to be output from the engine is equal to or greater than the prescribed power, even if the rate of fuel injection from the direct injection valve is set to 100%, the engine can be operated stably and the feedback control of the air-fuel ratio can be suppressed from failing. As a result, it is possible to suppress the air-fuel ratio from being richer (lower) than or leaner (higher) than a target value. Consequently, it is possible to suppress deterioration of emission during the malfunction diagnosis.

In the engine system, the prescribed power may be a power at which an amount of fuel injected from the direct injection valve does not fall below a minimum injectable amount and the engine is operated stably. The minimum injectable amount is an amount of fuel that is injectable from the direct injection valve even when the direct injection valve is malfunctioning while the engine is operated with the rate of fuel injection from the direct injection valve set to 100%.

A second aspect of the disclosure relates to a method of controlling an engine system. The engine system includes an engine and an electronic control unit. The engine includes a direct injection valve and a port injection valve. The direct injection valve is configured to inject fuel into a cylinder of the engine. The port injection valve is configured to inject fuel into an intake port of the engine. The method includes: controlling, by the electronic control unit, an operation of the engine by adjusting, based on a state of the engine, a rate of fuel injection from the direct injection valve with respect to total fuel injection and a rate of fuel injection from the port injection valve with respect to the total fuel injection; and executing, by the electronic control unit, a malfunction diagnosis with the rate of fuel injection from the direct injection valve set to 100%, when the electronic control unit determines that an execution condition for executing the malfunction diagnosis on a fuel system is satisfied and a power required to be output from the engine is equal to or greater than a prescribed power.

BRIEF DESCRIPTION OF THE DRAWINGS

Features, advantages, and technical and industrial significance of example embodiments will be described below with reference to the accompanying drawings, in which like numerals denote like elements, and wherein.

DETAILED DESCRIPTION OF EMBODIMENTS

Hereinafter, example embodiments of the disclosure will be described with reference to the accompanying drawings.

Figure 1:
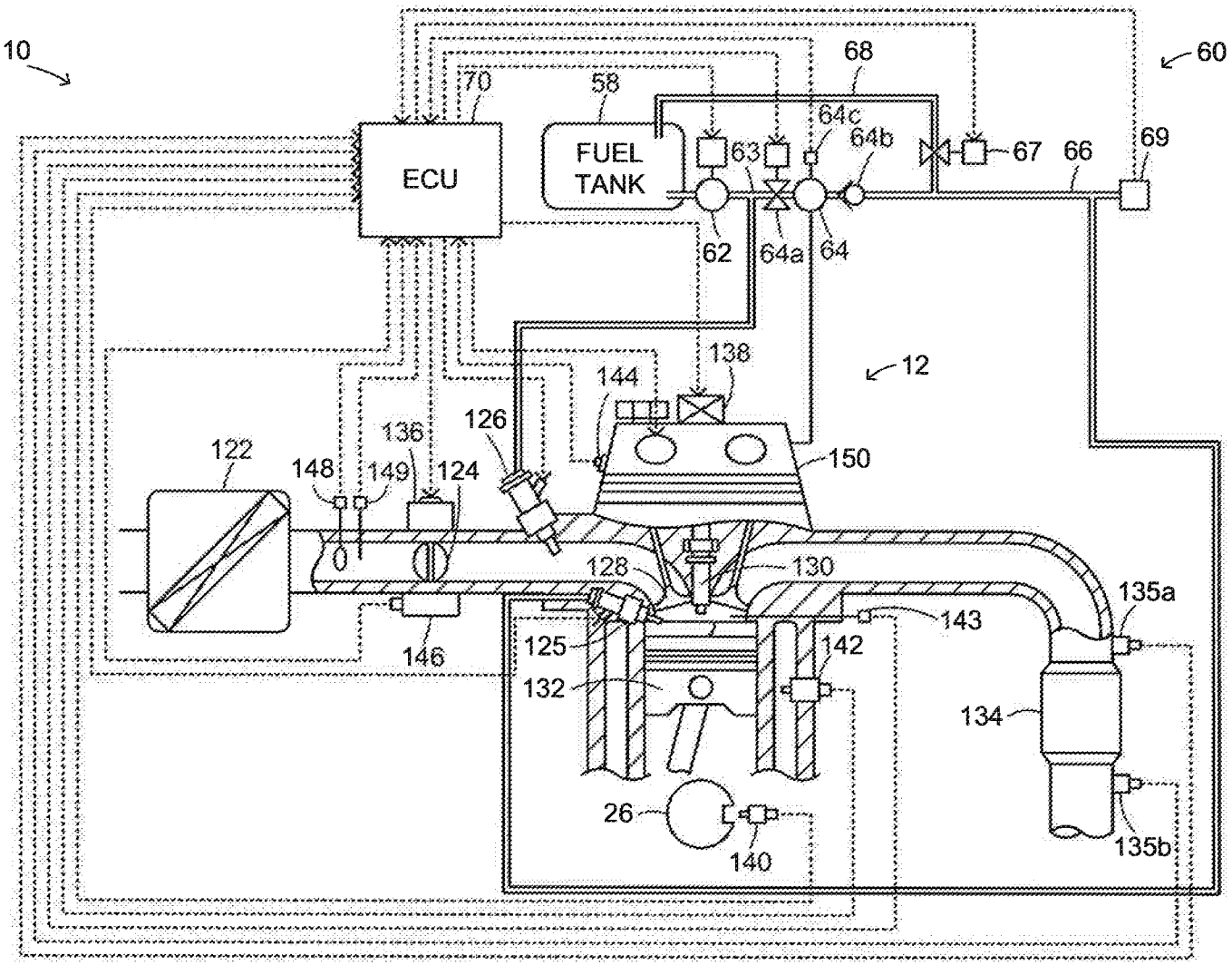
FIG. 1 is a diagram schematically illustrating the configuration of an engine system according to an embodiment of the disclosure.

FIG. 1 is a diagram schematically illustrating the configuration of an engine system 10 according to an embodiment of the disclosure. As illustrated in FIG. 1, the engine system 10 according to the present embodiment includes an engine 12, a fuel supply apparatus 60, and an electronic control unit (hereinafter, referred to as "ECU") 70 configured to control an operation of the engine 12. The engine system 10 is mounted in, for example, a vehicle that travels using only the power generated by the engine 12, or a hybrid vehicle that travels using the power generated by the engine 12 and the power generated by a motor (not illustrated).

The engine 12 is an internal combustion engine that includes a plurality of cylinders (e.g., four cylinders, six cylinders, or eight cylinders), and that is configured to output power using fuel, such as gasoline or diesel fuel. As illustrated in FIG. 1, the engine 12 includes direct injection valves 125 configured to inject fuel into the cylinders and port injection valves 126 configured to inject fuel into intake ports. Because the engine 12 includes the direct injection valves 125 and the port injection valves 126, the engine 12 can be operated in any one of a port injection mode, a direct injection mode, and a port-and-direct injection mode. In the port injection mode, the air cleaned by an air cleaner 122 is taken into each intake port via a throttle valve 124 and the fuel is injected into the intake port from the port injection valve 126, so that the air and the fuel are mixed together. The air-fuel mixture is taken into a combustion chamber while an intake valve 128 is open, and is then burned by an electric spark generated by an ignition plug 130. The reciprocating motion of a piston 132 pushed down by the energy released by the combustion is converted into a rotary motion of a crankshaft 26. In the direct injection mode, the air is taken into the combustion chamber, and the fuel is injected from the direct injection valve 125 in the course of an intake stroke or during a compression stroke. Then, the air-fuel mixture is burned by an electric spark generated by the ignition plug 130, so that the crankshaft 26 makes a rotary motion. In the port-and-direct injection mode, the fuel is injected from the port injection valve 126 while the air is taken into the combustion chamber, and the fuel is injected from the direct injection valve 125 during the intake stroke or the compression stroke. Then, the air-fuel mixture is burned by an electric spark generated by the ignition plug 130, so that the crankshaft 26 makes a rotary motion. The injection mode is switched among the port injection mode, the direct injection mode, and the port-and-direct injection mode, depending on the operating state of the engine 12. The exhaust gas from the combustion chamber is discharged to the outside atmosphere via an exhaust gas control apparatus 134 including an exhaust catalyst (three-way catalyst) configured to remove toxic substances, such as carbon monoxide (CO), hydrocarbon (HC), and nitrogen oxide (NOx).

The fuel supply apparatus 60 is an apparatus configured to supply the fuel from a fuel tank 58 to the direct injection valves 125 and the port injection valves 126 of the engine 12. The fuel supply apparatus 60 includes an electrically-driven fuel pump 62 and a high-pressure fuel pump 64. The fuel pump 62 is configured to supply the fuel from the fuel tank 58 to a fuel pipe 63 to which the port injection valves 126 are connected. The high-pressure fuel pump 64 is configured to pressurize the fuel in the fuel pipe 63 and supply the pressurized fuel to a delivery pipe 66 to which the direct injection valves 125 are connected. The fuel supply apparatus 60 further includes a relief valve 67 that is provided on a relief pipe 68 connected to the delivery pipe 66 and the fuel tank 58. The relief valve 67 is configured to reduce the pressure (fuel pressure) of the pressurized fuel in the delivery pipe 66 using the difference between the fuel pressure and the atmospheric pressure. The high-pressure fuel pump 64 is a pump configured to be driven by the power from the engine 12 (the rotation of the camshaft), thereby pressurizing the fuel in the fuel pipe 63. The high-pressure fuel pump 64 includes an electromagnetic valve 64*a* and a check valve 64*b*. The electromagnetic valve 64*a* is connected to an inlet of the high-pressure fuel pump 64 and configured to open and close to pressurize the fuel. The check valve 64*b* is connected to an outlet of the high-pressure fuel pump 64 and configured to prevent a backflow of the fuel and maintain the fuel pressure in the delivery pipe 66. Thus, the high-pressure fuel pump 64 takes in the fuel from the fuel pump 62 when the electromagnetic valve 64*a* is opened during the operation of the engine 12, and the high-pressure fuel pump 64 intermittently sends, to the delivery pipe 66 via the check valve 64*b*, the fuel compressed by a plunger (not illustrated) configured to be operated by the power generated by the engine 12 when the electromagnetic valve 64*a* is closed. In this way, the high-pressure fuel pump 64 pressurizes the fuel to be supplied to the delivery pipe 66. The relief valve 67 is an electromagnetic valve configured to be opened to prevent the fuel pressure in the delivery pipe 66 from being excessively high and to reduce the fuel pressure in the delivery pipe 66 when the engine 12 is stopped. When the relief valve 67 is opened, the fuel is returned from the delivery pipe 66 to the fuel tank 58 through the relief pipe 68.

The ECU 70 is a microprocessor mainly including a central processing unit (CPU). The ECU 70 includes, in addition to the CPU, a read-only memory (ROM) that stores processing programs, a random-access memory (RAM) that temporarily stores data, an input port, an output port, and a communication port (which are not illustrated).

Signals from various sensors, which are required to control the operation of the engine 12, are input into the ECU 70 via the input port. Examples of the signals input into the ECU 70 include a crank position θcr from a crank position sensor 140 configured to detect a rotation position of the crankshaft 26, and a coolant temperature Tw from a coolant temperature sensor 142 configured to detect a temperature of a coolant for the engine 12. Examples of the signals input into the ECU 70 further include an in-cylinder pressure Pin from a pressure sensor 143 provided inside the combustion chamber, and a cam position θca from a cam position sensor 144 configured to detect a rotation position of an intake camshaft configured to open and close the intake valves 128 and a rotation position of an exhaust camshaft configured to open and close exhaust valves. Examples of the signals input into the ECU 70 further include a throttle opening amount TH from a throttle valve position sensor 146 configured to detect a position of the throttle valve 124, an intake air amount Qa from an air flow meter 148 attached to an intake pipe, and an intake air temperature Ta from a temperature sensor 149 attached to the intake pipe. Examples of the signals input into the ECU 70 further include an air-fuel ratio AF from an air-fuel ratio sensor 135*a* attached to an exhaust pipe, and an oxygen signal O2 from an oxygen sensor 135*b* attached to the exhaust pipe. Examples of the signals input into the ECU 70 further include a rotation speed Np from a rotation speed sensor 64*c* configured to detect a rotation speed of the high-pressure fuel pump 64, and a fuel pressure Pf (hereinafter, referred to as "detected fuel pressure Pfdet") from a fuel pressure sensor 69 configured to detect a fuel pressure (a fuel pressure of the fuel to be supplied to the direct injection valves 125) in the delivery pipe 66 of the fuel supply apparatus 60.

The ECU 70 outputs, via the output port, various control signals used to control the operation of the engine 12. Examples of the signals output from the ECU 70 include a drive signal for each direct injection valve 125, a drive signal for each port injection valve 126, a drive signal for a throttle motor 136 used to adjust the position of the throttle valve 124, and a control signal for each ignition coil 138 that is integral with an igniter. Examples of the signals output from the ECU 70 include a control signal for a variable valve timing mechanism 150 configured to vary the opening timing and the closing timing of the intake valves 128, a drive signal for the fuel pump 62, a drive signal for the electromagnetic valve 64*a* of the high-pressure fuel pump 64, and a drive signal for the relief valve 67.

The ECU 70 calculates an engine speed Ne of the engine 12 based on the crank position θcr from the crank position sensor 140, and calculates a volumetric efficiency KL (i.e., a ratio of the volume of air actually taken into a cylinder during one cycle with respect to a stroke volume for one cycle in the engine 12) based on the intake air amount Qa from the air flow meter 148 and the engine speed Ne of the engine 12.

In the engine system 10 according to the present embodiment, which has the foregoing configuration, the ECU 70 executes intake air amount control, fuel injection control, and ignition control on the engine 12 such that the engine 12 is operated at a target engine speed Ne* so as to generate a target torque Te*. Detailed description of the ignition control will be omitted. In the intake air amount control, a target air amount Qa* is set based on the target torque Te*, a target throttle opening amount TH* is set such that the intake air amount Qa coincides with the target air amount Qa*, and driving of the throttle motor 136 is controlled such that the throttle opening amount TH coincides with the target throttle opening amount TH*. In the fuel injection control, first, an injection mode to be executed (hereinafter, referred to as "execution injection mode") is selected from among the port injection mode, the direct injection mode, and the port-and-direct injection mode, based on the operating state of the engine 12 (e.g., the engine speed Ne and the volumetric efficiency KL of the engine 12). Next, a target fuel injection amount Qfd* for the direct injection valve 125, and a target fuel injection amount Qfp* for the port injection valve 126 are set based on the target air amount Qa* and the execution injection mode, such that the air-fuel ratio AF coincides with a target air-fuel ratio AF* (e.g., the stoichiometric air-fuel ratio). Subsequently, a target fuel injection duration τfd* for the direct injection valve 125 and a target fuel injection duration τfp* for the port injection valve 126 are set based respectively on the target fuel injection amounts Qfd*, Qfp*. Then, driving of the direct injection valve 125 and driving of the port injection valve 126 are controlled such that the fuel is injected from the direct injection valve 125 over the target fuel injection duration τfd* and the fuel is injected from the port injection valve 126 over the target fuel injection duration τfp*.

The target fuel injection duration τfd* for the direct injection valve 125 is set basically based on the target fuel injection amount Qfd* and the detected fuel pressure Pfdet from the fuel pressure sensor 69. However, the target fuel injection duration τfd* is set such that the amount of fuel injected from the direct injection valve 125 does not fall below a minimum injectable amount Qmin for the direct injection valve 125, which is determined based on the detected fuel pressure Pfdet from the fuel pressure sensor 69. The target fuel injection duration τfd* is subjected to feedback control based on the air-fuel ratio AF detected by the air-fuel ratio sensor 135*a*. The target fuel injection duration τfd* is set to be longer when the target fuel injection amount Qfd* is large, than when the target fuel injection amount Qfd* is small. More specifically, the target fuel injection duration τfd* is set to be longer as the target fuel injection amount Qfd* is larger, and is set to be shorter as the detected fuel pressure Pfdet is higher. The target fuel injection duration τfp* for the port injection valve 126 is set basically based on the target fuel injection amount Qfp*. However, the target fuel injection duration τfp* is subjected to feedback control based on the air-fuel ratio AF detected by the air-fuel ratio sensor 135*a*. Specifically, the target fuel injection duration τfp* is set to be longer when the target fuel injection amount Qfp* is large, than when the target fuel injection amount Qfp* is small. More specifically, the target fuel injection duration τfp* is set to be longer as the target fuel injection amount Qfp* is larger.

While the engine 12 is operated, driving of the high-pressure fuel pump 64 (the electromagnetic valve 64*a*) is controlled such that the detected fuel pressure Pfdet coincides with a target fuel pressure Pf*. The target fuel pressure Pf* is set based on the operating state of the engine 12 (e.g., the engine speed Ne and the volumetric efficiency KL of the engine 12). In the present embodiment, until a certain period of time has elapsed from the start of operation of the engine 12, the fuel injection control is executed with the direct injection mode set as the execution injection mode.

Figure 2:
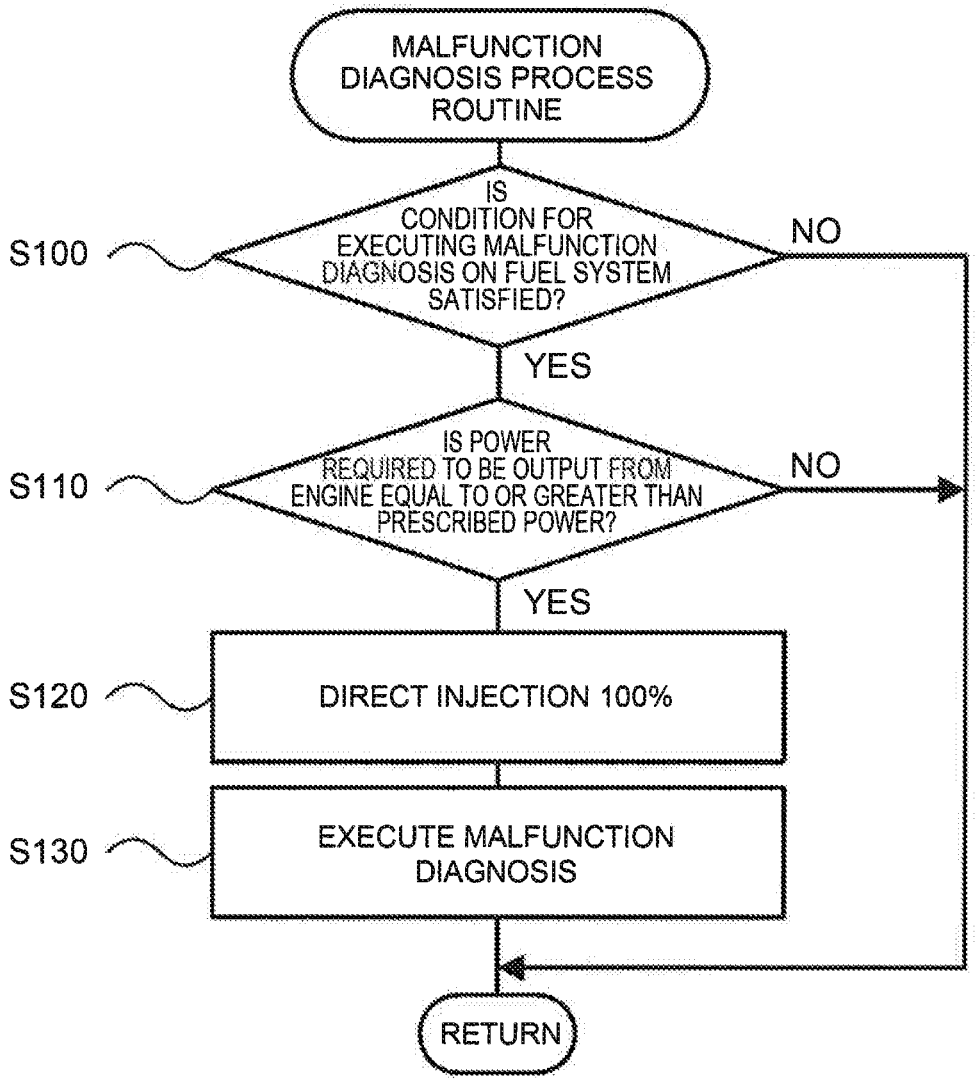
FIG. 2 is a flowchart illustrating an example of a malfunction diagnosis process routine executed by an electronic control unit (ECU).

Next, the operation of the engine system 10 according to the present embodiment, which has the foregoing configuration, will be described. More specifically, description will be provided on the operation of the engine system 10 when a malfunction diagnosis is executed with the rate of fuel injection from the direct injection valve 125 with respect to the total fuel injection set to 100%. FIG. 2 is a flowchart illustrating an example of a malfunction diagnosis process routine executed by the ECU 70. The routine is repeatedly executed at prescribed time intervals (e.g., at time intervals of several tens of milliseconds) until the completion of the malfunction diagnosis that is executed when the rate of fuel injection from the direct injection valve 125 is 100%.

Upon startup of the malfunction diagnosis process routine, the ECU 70 first determines whether an execution condition for executing a malfunction diagnosis on a fuel system is satisfied (step S100). Examples of the execution condition include a condition that warming-up of the engine 12 has been completed and a condition that no sudden change has occurred in the engine speed of the engine 12. When the ECU 70 determines that the execution condition for executing the malfunction diagnosis on the fuel system is not satisfied, the ECU 70 ends the routine without executing the malfunction diagnosis.

On the other hand, when the ECU 70 determines that the execution condition for executing the malfunction diagnosis on the fuel system is satisfied, the ECU 70 determines whether a required power Pe* required of the engine 12 (i.e., required to be output from the engine 12) is equal to or greater than a prescribed power Pref (step S110). The required power Pe* is a power required to be output from the engine 12 in response to a driver's accelerator operation, for example, when the engine system 10 is mounted in the vehicle as a drive source for the vehicle. The prescribed power Pref is a power that is equal to or slightly greater than the lower limit of a range of power in which the amount of fuel injected from the direct injection valve 125 does not fall below the minimum injectable amount Qmin and the engine 12 can be operated stably. The minimum injectable amount Qmin is an amount of fuel that can be injected from the direct injection valve 125 even when the direct injection valve 125 is malfunctioning while the engine 12 is operated with the rate of fuel injection from the direct injection valve 125 set to 100%. The prescribed power Pref can be acquired through, for example, experiments, based on the kind of the engine 12. If the malfunction diagnosis is executed with the rate of fuel injection from the direct injection valve 125 set to 100% when the required power Pe* required of the engine 12 is less than the prescribed power Pref, the following problem may occur. That is, when an excessively large amount of fuel is injected from the direct injection valve 125 due to a malfunction thereof, the ECU 70 executes the feedback control based on the air-fuel ratio AF from the air-fuel ratio sensor 135*a* and the command value of the amount of fuel to be injected from the direct injection valve 125 falls below the minimum injectable amount Qmin. Thus, the feedback control cannot be executed appropriately. As a result, the air-fuel ratio may become leaner (higher) than or richer (lower) than a target value, leading to deterioration of emission. For this reason, the malfunction diagnosis on the fuel system is executed on a precondition that the required power Pe* required of the engine 12 is equal to or greater than the prescribed power Pref. When the ECU 70 determines that the required power Pe* required of the engine 12 is less than the prescribed power Pref, the ECU 70 determines that it is difficult to appropriately execute the malfunction diagnosis, and ends the routine.

When the ECU 70 determines in step S110 that the required power Pe* required of the engine 12 is equal to or greater than the prescribed power Pref, the ECU 70 sets the rate of fuel injection from the direct injection valve 125 to 100% (step S120), then executes the malfunction diagnosis on the fuel system (step S130), and then ends the routine. Examples of the malfunction diagnosis on the fuel system include a malfunction diagnosis on the air-fuel ratio sensor 135*a*, a malfunction diagnosis on the oxygen sensor 135*b*, a malfunction diagnosis on the direct injection valve 125, and a malfunction diagnosis on a high-pressure system of the fuel supply apparatus 60. As described above, when the required power Pe* required of the engine 12 is equal to or greater than the prescribed power Pref, the amount of fuel injected from the direct injection valve 125 does not fall below the minimum injectable amount Qmin and the engine 12 can be operated stably. The minimum injectable amount Qmin is an amount of fuel that can be injected from the direct injection valve 125 even when the direct injection valve 125 is malfunctioning while the engine 12 is operated with the rate of fuel injection from the direct injection valve 125 set to 100%. Therefore, even when the direct injection valve 125 is malfunctioning, the feedback control of the air-fuel ratio AF can be appropriately executed. As a result, deterioration of the emission can be suppressed even during the malfunction diagnosis.

In the engine system 10 according to the present embodiment, which has the foregoing configuration, when the execution condition for executing the malfunction diagnosis on the fuel system is satisfied, the ECU 70 determines whether the required power Pe* required of the engine 12 is equal to or greater than the prescribed power Pref. When the ECU 70 determines that the required power Pe* required of the engine 12 is equal to or greater than the prescribed power Pref, the ECU 70 sets the rate of fuel injection from the direct injection valve 125 to 100% and then executes the malfunction diagnosis on the fuel system. In a state where the required power Pe* required of the engine 12 is equal to or greater than the prescribed power Pref, even when the rate of fuel injection from the direct injection valve 125 is 100%, the amount of fuel injected from the direct injection valve 125 does not fall below the minimum injectable amount Qmin and the engine 12 can be operated stably. The minimum injectable amount Qmin is an amount of fuel that can be injected from the direct injection valve 125 even when the direct injection valve 125 is malfunctioning. Therefore, the feedback control of the air-fuel ratio AF can be appropriately executed. As a result, deterioration of the emission can be suppressed even during the malfunction diagnosis on the fuel system.

Next, description will be provided on the correspondence relationship between the main elements in the foregoing embodiment and the main elements in Summary. The direct injection valve 125 in the foregoing embodiment is an example of "direct injection valve" in Summary, the port injection valve 126 in the foregoing embodiment is an example of "port injection valve" in Summary, the engine 12 in the foregoing embodiment is an example of "engine" in Summary, and the electronic control unit (ECU) 70 in the foregoing embodiment is an example of "electronic control unit" in Summary.

The foregoing embodiment is one example for concretely describing a mode for carrying out the disclosure described in Summary. Therefore, the correspondence relationship between the main elements in the foregoing embodiment and the main elements in Summary is not intended to limit the elements of the disclosure described in Summary. That is, the disclosure described in Summary should be interpreted based on the description in Summary, and the forgoing embodiment is merely one example of the disclosure described in Summary.

While one example embodiment of the disclosure has been described above, the disclosure is not limited to the foregoing example embodiment, and the disclosure may be implemented in various other embodiments within the scope of the disclosure.

The disclosure is applicable to, for example, the industry for manufacturing engine systems.

What is claimed is:

1. An engine system comprising:

an engine including a direct injection valve and a port injection valve, the direct injection valve being configured to inject fuel into a cylinder of the engine, and the port injection valve being configured to inject fuel into an intake port of the engine; and an electronic control unit configured to control an operation of the engine by adjusting, based on a state of the engine, a rate of fuel injection from the direct injection valve with respect to total fuel injection and a rate of fuel injection from the port injection valve with respect to the total fuel injection, the electronic control unit being configured to execute a malfunction diagnosis with the rate of fuel injection from the direct injection valve set to 100% of the total fuel injection, when the electronic control unit determines that a precondition for executing the malfunction diagnosis on a fuel system is satisfied and a power required to be output from the engine in response to operation of an accelerator by a driver of a vehicle including the engine system as a drive source for the vehicle is equal to or greater than a prescribed power, wherein the prescribed power is a power at which an amount of fuel injected from the direct injection valve does not fall below a minimum injectable amount and the engine is operated stably, the minimum injectable amount being determined based on a fuel pressure at which fuel is supplied to the direct injection valve and being an amount of fuel that is injectable from the direct injection valve even when the direct injection valve is malfunctioning while the engine is operated with the rate of fuel injection from the direct injection valve set to 100% of the total fuel injection, and the precondition for executing the malfunction diagnosis including one or more of a condition that an engine warmup has been completed and a condition that there have been no sudden changes in engine speed, and the malfunction diagnosis including a malfunction diagnosis on one or more of an air-fuel ratio sensor, an oxygen sensor, the direct injection valve, and a high pressure system supplying fuel to the direct injection valve.

2. A method of controlling an engine system, the engine system including an engine and an electronic control unit, the engine including a direct injection valve and a port injection valve, the direct injection valve being configured to inject fuel into a cylinder of the engine, and the port injection valve being configured to inject fuel into an intake port of the engine, the method comprising:

controlling, by the electronic control unit, an operation of the engine by adjusting, based on a state of the engine, a rate of fuel injection from the direct injection valve with respect to total fuel injection and a rate of fuel injection from the port injection valve with respect to the total fuel injection; and executing, by the electronic control unit, a malfunction diagnosis with the rate of fuel injection from the direct injection valve set to 100% of the total fuel injection, when the electronic control unit determines that a precondition for executing the malfunction diagnosis on a fuel system is satisfied and a power required to be output from the engine in response to operation of an accelerator by a driver of a vehicle including the engine system as a drive source for the vehicle is equal to or greater than a prescribed power, wherein the prescribed power is a power at which an amount of fuel injected from the direct injection valve does not fall below a minimum injectable amount and the engine is operated stably, the minimum injectable amount being determined based on a fuel pressure at which fuel is supplied to the direct injection valve and being an amount of fuel that is injectable from the direct injection valve even when the direct injection valve is malfunctioning while the engine is operated with the rate of fuel injection from the direct injection valve set to 100% of the total fuel injection, and the precondition for executing the malfunction diagnosis including one or more of a condition that an engine warmup has been completed and a condition that there have been no sudden changes in engine speed, and the malfunction diagnosis including a malfunction diagnosis on one or more of an air-fuel ratio sensor, an oxygen sensor, the direct injection valve, and a high pressure system supplying fuel to the direct injection valve.

* * * * *